US008978786B2

(12) United States Patent
Nguyen et al.

(10) Patent No.: US 8,978,786 B2
(45) **Date of Patent: *Mar. 17, 2015**

(54) SYSTEM AND METHOD FOR ADJUSTING ROLLER CONE PROFILE ON HYBRID BIT

(75) Inventors: Don Q. Nguyen, Houston, TX (US); Anton F. Zahradnik, Sugar Land, TX (US); Rudolf C. Pessier, Houston, TX (US); Mark P. Blackman, Conroe, TX (US); Robert D. Bradshaw, The Woodlands, TX (US); Scott A. Young, Montgomery, TX (US); Ronny D. McCormick, Magnolia, TX (US); Shyam Anandampillai, Houston, TX (US); Michael S. Damschen, Houston, TX (US); Robert J. Buske, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 471 days.

This patent is subject to a terminal disclaimer.

(21) Appl. No.: 12/939,367

(22) Filed: Nov. 4, 2010

(65) Prior Publication Data

US 2012/0111638 A1 May 10, 2012

(51) Int. Cl.

| | |
|---|---|
| ***E21B 10/633*** | (2006.01) |
| ***E21B 10/14*** | (2006.01) |
| ***E21B 10/00*** | (2006.01) |

(52) U.S. Cl.

CPC ..... *E21B 10/00* (2013.01); *E21B 10/14* (2013.01)

USPC ..... 175/336; 175/342; 175/382; 175/413

(58) Field of Classification Search

USPC ..... 175/342, 382, 412, 413, 336

See application file for complete search history.

(56) References Cited

U.S. PATENT DOCUMENTS

| | | | |
|---|---|---|---|
| 930,759 | A | 8/1909 | Hughes |
| 1,388,424 | A | 9/1921 | George |

(Continued)

FOREIGN PATENT DOCUMENTS

| | | |
|---|---|---|
| DE | 13 01 784 | 8/1969 |
| EP | 0225101 | 6/1987 |

(Continued)

OTHER PUBLICATIONS

Kang, K.H., International Search Report for International Patent Application No. PCT/US2010/033513, Korean Intellectual Property Office, dated Jan. 10, 2011.

(Continued)

*Primary Examiner* — David Andrews

(74) *Attorney, Agent, or Firm* — Cantor Colburn LLP

(57) ABSTRACT

An earth boring drill bit designed for a specific performance, within a finished product tolerance, using components built to a looser manufacturing tolerance. The bit may be assembled by selecting a leg from a plurality of pre-manufactured legs; selecting a bit body from a plurality of pre-manufactured bit bodies, the bit body having a slot for receiving the leg; placing the leg within the slot; and fixing the leg within the slot within the finished product tolerance by placing one or more shims between the leg and the slot. The shims may be used to adjust an axial position, a radial position, and/or a circumferential position of the leg with respect to the slot. The leg and the bit body may be selected, or produced, to ensure the bit will not meet the specification, given the manufacturing tolerance, without the shims.

18 Claims, 9 Drawing Sheets

(56) References Cited

U.S. PATENT DOCUMENTS

| | | | |
|---|---|---|---|
| 1,394,769 | A | 10/1921 | Sorensen |
| 1,519,641 | A | 12/1924 | Thompson |
| 1,816,568 | A | 7/1931 | Carlson |
| 1,821,474 | A | 9/1931 | Mercer |
| 1,874,066 | A | 8/1932 | Scott et al. |
| 1,879,127 | A | 9/1932 | Schlumpf |
| 1,896,243 | A | 2/1933 | Macdonald |
| 1,932,487 | A | 10/1933 | Scott |
| 2,030,722 | A | 2/1936 | Scott |
| 2,117,481 | A | 5/1938 | Howard et al. |
| 2,119,618 | A | 6/1938 | Zublin |
| 2,198,849 | A | 4/1940 | Waxier |
| 2,216,894 | A | 10/1940 | Stancliff |
| 2,244,537 | A | 6/1941 | Kammerer |
| 2,297,157 | A | 9/1942 | McClinton |
| 2,320,136 | A | 5/1943 | Kammerer |
| 2,320,137 | A | 5/1943 | Kammerer |
| 2,380,112 | A | 7/1945 | Kinnear |
| RE23,416 | E | 10/1951 | Kinnear |
| 2,719,026 | A | 9/1955 | Boice |
| 2,815,932 | A | 12/1957 | Wolfram |
| 2,994,389 | A | 8/1961 | Bus, Sr. |
| 3,010,708 | A | 11/1961 | Hlinsky et al. |
| 3,050,293 | A | 8/1962 | Hlinsky |
| 3,055,443 | A | 9/1962 | Edwards |
| 3,066,749 | A | 12/1962 | Hildebrandt |
| 3,126,066 | A | 3/1964 | Williams, Jr. |
| 3,126,067 | A | 3/1964 | Schumacher, Jr. |
| 3,174,564 | A | 3/1965 | Morlan |
| 3,239,431 | A | 3/1966 | Raymond |
| 3,250,337 | A | 5/1966 | Demo |
| 3,269,469 | A | 8/1966 | Kelly, Jr. |
| 3,387,673 | A | 6/1968 | Thompson |
| 3,424,258 | A | 1/1969 | Nakayama |
| 3,583,501 | A | 6/1971 | Aalund |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |
| 4,320,808 | A | 3/1982 | Garrett |
| 4,343,371 | A | 8/1982 | Baker, III et al. |
| 4,359,112 | A | 11/1982 | Garner et al. |
| 4,369,849 | A | 1/1983 | Parrish |
| 4,386,669 | A | 6/1983 | Evans |
| 4,410,284 | A | 10/1983 | Herrick |
| 4,428,687 | A | 1/1984 | Zahradnik |
| 4,444,281 | A | 4/1984 | Schumacher, Jr. et al. |
| 4,527,637 | A | 7/1985 | Bodine |
| 4,572,306 | A | 2/1986 | Dorosz |
| 4,657,091 | A | 4/1987 | Higdon |
| 4,664,705 | A | 5/1987 | Horton et al. |
| 4,690,228 | A | 9/1987 | Voelz et al. |
| 4,706,765 | A | 11/1987 | Lee et al. |
| 4,726,718 | A | 2/1988 | Meskin et al. |
| 4,727,942 | A | 3/1988 | Galle et al. |
| 4,738,322 | A | 4/1988 | Hall et al. |
| 4,765,205 | A | 8/1988 | Higdon |
| 4,874,047 | A | 10/1989 | Hixon |
| 4,875,532 | A | 10/1989 | Langford, Jr. |
| 4,892,159 | A | 1/1990 | Holster |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,976,324 | A | 12/1990 | Tibbitts |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,028,177 | A | 7/1991 | Meskin et al. |
| 5,030,276 | A | 7/1991 | Sung et al. |
| 5,049,164 | A | 9/1991 | Horton et al. |
| 5,116,568 | A | 5/1992 | Sung et al. |
| 5,145,017 | A | 9/1992 | Holster et al. |
| 5,176,212 | A | 1/1993 | Tandberg |
| 5,224,560 | A | 7/1993 | Fernandez |
| 5,238,074 | A | 8/1993 | Tibbitts et al. |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,346,026 | A | 9/1994 | Pessier et al. |
| 5,351,770 | A | 10/1994 | Cawthorne et al. |
| 5,361,859 | A | 11/1994 | Tibbitts |
| 5,429,200 | A | 7/1995 | Blackman et al. |
| 5,439,068 | A | 8/1995 | Huffstutler et al. |
| 5,452,771 | A | 9/1995 | Blackman et al. |
| 5,467,836 | A | 11/1995 | Grimes et al. |
| 5,472,057 | A | 12/1995 | Winfree |
| 5,472,271 | A | 12/1995 | Bowers et al. |
| 5,513,715 | A | 5/1996 | Dysart |
| 5,518,077 | A | 5/1996 | Blackman et al. |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,560,440 | A | 10/1996 | Tibbitts |
| 5,570,750 | A | 11/1996 | Williams |
| 5,593,231 | A | 1/1997 | Ippolito |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,092,613 | A | 7/2000 | Caraway et al. |
| 6,095,265 | A | 8/2000 | Alsup |
| 6,109,375 | A | 8/2000 | Tso |
| 6,116,357 | A | 9/2000 | Wagoner et al. |
| 6,173,797 | B1 | 1/2001 | Dykstra et al. |
| 6,220,374 | B1 | 4/2001 | Crawford |
| 6,241,034 | B1 | 6/2001 | Steinke et al. |
| 6,241,036 | B1 | 6/2001 | Lovato et al. |
| 6,250,407 | B1 | 6/2001 | Karlsson |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,345,673 | B1 | 2/2002 | Siracki |
| 6,360,831 | B1 | 3/2002 | Akesson et al. |
| 6,367,568 | B2 | 4/2002 | Steinke et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,439,326 | B1 | 8/2002 | Huang et al. |
| 6,446,739 | B1 | 9/2002 | Richman et al. |
| 6,450,270 | B1 | 9/2002 | Saxton |
| 6,460,635 | B1 | 10/2002 | Kalsi et al. |
| 6,474,424 | B1 | 11/2002 | Saxman |
| 6,510,906 | B1 | 1/2003 | Richert et al. |
| 6,510,909 | B2 | 1/2003 | Garcia et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |

(56) References Cited

U.S. PATENT DOCUMENTS

| | | | |
|---|---|---|---|
| 6,581,700 | B2 | 6/2003 | Curlett et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,745,858 | B1 | 6/2004 | Estes |
| 6,749,033 | B2 | 6/2004 | Griffin et al. |
| 6,797,326 | B2 | 9/2004 | Griffin et al. |
| 6,823,951 | B2 | 11/2004 | Yong et al. |
| 6,843,333 | B2 | 1/2005 | Richert et al. |
| 6,861,098 | B2 | 3/2005 | Griffin et al. |
| 6,861,137 | B2 | 3/2005 | Hughes et al. |
| 6,878,447 | B2 | 4/2005 | Griffin et al. |
| 6,883,623 | B2 | 4/2005 | McCormick et al. |
| 6,902,014 | B1 | 6/2005 | Estes |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,137,460 | B2 | 11/2006 | Slaughter, Jr. et al. |
| 7,152,702 | B1 | 12/2006 | Bhome et al. |
| 7,197,806 | B2 | 4/2007 | Boudreaux et al. |
| 7,198,119 | B1 | 4/2007 | Hall et al. |
| 7,234,550 | B2 | 6/2007 | Azar et al. |
| 7,270,196 | B2 | 9/2007 | Hall |
| 7,281,592 | B2 | 10/2007 | Runia et al. |
| 7,320,375 | B2 | 1/2008 | Singh |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |
| 7,416,036 | B2 | 8/2008 | Forstner et al. |
| 7,435,478 | B2 | 10/2008 | Keshavan |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,517,589 | B2 | 4/2009 | Eyre |
| 7,533,740 | B2 | 5/2009 | Zhang et al. |
| 7,568,534 | B2 | 8/2009 | Griffin et al. |
| 7,621,346 | B1 | 11/2009 | Trinh et al. |
| 7,621,348 | B2 | 11/2009 | Hoffmaster et al. |
| 7,703,556 | B2 | 4/2010 | Smith et al. |
| 7,703,557 | B2 | 4/2010 | Durairajan et al. |
| 7,819,208 | B2 | 10/2010 | Pessier et al. |
| 7,836,975 | B2 | 11/2010 | Chen et al. |
| 7,845,435 | B2 | 12/2010 | Zahradnik et al. |
| 7,845,437 | B2 | 12/2010 | Bielawa et al. |
| 7,847,437 | B2 | 12/2010 | Chakrabarti et al. |
| 2002/0092684 | A1 | 7/2002 | Singh et al. |
| 2002/0108785 | A1 | 8/2002 | Slaughter, Jr. et al. |
| 2004/0099448 | A1 | 5/2004 | Fielder et al. |
| 2004/0238224 | A1 | 12/2004 | Runia |
| 2005/0087370 | A1 | 4/2005 | Ledgerwood, III et al. |
| 2005/0103533 | A1 | 5/2005 | Sherwood, Jr. et al. |
| 2005/0178587 | A1 | 8/2005 | Witman, IV et al. |
| 2005/0183892 | A1 | 8/2005 | Oldham et al. |
| 2005/0263328 | A1 | 12/2005 | Middlemiss |
| 2005/0273301 | A1 | 12/2005 | Huang |
| 2006/0032674 | A1 | 2/2006 | Chen et al. |
| 2006/0032677 | A1 | 2/2006 | Azar et al. |
| 2006/0162969 | A1 | 7/2006 | Belnap et al. |
| 2006/0196699 | A1 | 9/2006 | Estes et al. |
| 2006/0254830 | A1 | 11/2006 | Radtke |
| 2006/0266558 | A1 | 11/2006 | Middlemiss et al. |
| 2006/0266559 | A1 | 11/2006 | Keshavan et al. |
| 2006/0278442 | A1 | 12/2006 | Kristensen |
| 2006/0283640 | A1 | 12/2006 | Estes et al. |
| 2007/0029114 | A1 | 2/2007 | Middlemiss |
| 2007/0062736 | A1 | 3/2007 | Cariveau et al. |
| 2007/0079994 | A1 | 4/2007 | Middlemiss |
| 2007/0187155 | A1 | 8/2007 | Middlemiss |
| 2007/0221417 | A1 | 9/2007 | Hall et al. |
| 2008/0066970 | A1 | 3/2008 | Zahradnik et al. |
| 2008/0264695 | A1 | 10/2008 | Zahradnik et al. |
| 2008/0296068 | A1 | 12/2008 | Zahradnik et al. |
| 2009/0114454 | A1 | 5/2009 | Belnap et al. |
| 2009/0120693 | A1 | 5/2009 | McClain et al. |
| 2009/0126998 | A1 | 5/2009 | Zahradnik et al. |
| 2009/0159338 | A1 | 6/2009 | Buske |
| 2009/0159341 | A1 | 6/2009 | Pessier et al. |
| 2009/0166093 | A1 | 7/2009 | Pessier et al. |
| 2009/0178855 | A1 | 7/2009 | Zhang et al. |
| 2009/0183925 | A1 | 7/2009 | Zhang et al. |
| 2009/0272582 | A1 | 11/2009 | McCormick et al. |
| 2010/0224417 | A1 | 9/2010 | Zahradnik et al. |
| 2010/0276205 | A1 | 11/2010 | Oxford et al. |
| 2010/0288561 | A1 | 11/2010 | Zahradnik et al. |
| 2010/0320001 | A1 | 12/2010 | Kulkarni |
| 2011/0024197 | A1 | 2/2011 | Centala et al. |
| 2011/0079440 | A1 | 4/2011 | Buske et al. |
| 2011/0079441 | A1 | 4/2011 | Buske et al. |
| 2011/0079442 | A1 | 4/2011 | Buske et al. |
| 2011/0079443 | A1 | 4/2011 | Buske et al. |
| 2011/0162893 | A1 | 7/2011 | Zhang |

FOREIGN PATENT DOCUMENTS

| | | |
|---|---|---|
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2000080878 | 3/2000 |
| JP | 2001159289 | 6/2001 |
| SU | 1 331 988 | 8/1987 |
| WO | 8502223 | 5/1985 |
| WO | 2008124572 | 10/2008 |

OTHER PUBLICATIONS

Kang, K.H., Written Opinion for International Patent Application No. PCT/US2010/033513, Korean Intellectual Property Office, dated Jan. 10, 2011.

Kang, M.S., International Search Report for International Patent Application No. PCT/US2010/032511, Korean Intellectual Property Office, dated Jan. 17, 2011.

Kang, M.S., Written Opinion for International Patent Application No. PCT/US2010/032511, Korean Intellectual Property Office, dated Jan. 17, 2011.

Choi, J.S., International Search Report for International Patent Application No. PCT/US2010/039100, Korean Intellectual Property Office, dated Jan. 25, 2011.

Choi, J.S., Written Opinion for International Patent Application No. PCT/US2010/039100, Korean Intellectual Property Office, dated Jan. 25, 2011.

Baharlou, S., International Preliminary Report on Patentability, The International Bureau of WIPO, dated Jan. 25, 2011.

Georgescu, M., International Search Report for International Patent Application No. PCT/US2010/051019, date Jun. 6, 2011, European Patent Office.

Georgescu, M., Written Opinion for International Patent Application No. PCT/US20101051019, dated Jun. 6, 2011, European Patent Office.

Georgescu, M., International Search Report for International Patent Application No. PCT/US2010/051020, dated Jun. 1, 2011, European Patent Office.

Georgescu, M., Written Opinion for International Patent Application No. PCT/US20101051020, dated Jun. 1, 2011, European Patent Office.

Georgescu, M., International Search Report for International Patent Application No. PCT/US2010/051017, dated Jun. 8, 2011, European Patent Office.

(56) References Cited

OTHER PUBLICATIONS

Georgescu, M., Written Opinion for International Patent Application No. PCT/US20101051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.
Jung Hye Lee, International Search Report for International Patent Application No. PCT/US20091042514, Korean Intellectual Property Office, dated Nov. 27, 2009.
Jung Hye Lee, copy of Written Opinion for International Patent Application No. PCT/US2009/042514, Korean Intellectual Property Office, dated Nov. 27, 2009.
Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.
Sung Joon Lee, International Search Report for International Patent Application No. PCT/US2009/050672, Korean Intellectual Property Office, dated Mar. 3, 2010.
Sung Joon Lee, Written Opinion for International Patent Application No. PCT/US2009/050672, Korean Intellectual Property Office, dated Mar. 3, 2010.
S.H. Kim, International Search Report for International Patent Application No. PCT/US2009/067969, Korean Intellectual Property Office, dated May 25, 2010.
S.H. Kim, Written Opinion for International Patent Application No. PCT/US2009/067969, Korean Intellectual Property Office, dated May 25, 2010.
Beijer, G., International Preliminary Report on Patentability for International Patent Application No. PCT/US2009/042514, The International Bureau of WIPO, dated Nov. 2, 2010.
Adri Schouten, International Search Report for International Patent Application No. PCT/US2008/083532, European Patent Office, dated Feb. 25, 2009.
Adri Schouten, Written Opinion for International Patent Application No. PCT/US2008/083532, European Patent Office, dated Feb. 25, 2009.
Sheppard, N. and Dolly, B. "Rock Drilling—Hybrid Bit Success for Syndax3 Pins." Industrial Diamond Review, Jun. 1993, pp. 309-311.
Tomlinson, P. and Clark, I. "Rock Drilling—Syndax3 Pins-New Concepts in PCD Drilling." Industrial Diamond Review, Mar. 1992, pp. 109-114.
Williams, J. and Thompson, A. "An Analysis of the Performance of PDC Hybrid Drill Bits." SPE/IADC 16117, SPE/IADC Drilling Conference, Mar. 1987, pp. 585-594.
Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.
Smith Services. "Hole Opener—Model 6980 Hole Opener." [retrieved from the Internet on May 7, 2008 using <URL: http://www.siismithservices.com/b_products/product_page.asp?ID=589>].
Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].
Ersoy, A. and Waller, M. "Wear characteristics of PDC pin and hybrid core bits in rock drilling." Wear 188, Elsevier Science S.A., Mar. 1995, pp. 150-165.
R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.
Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.
B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.
Becamel, P., International Preliminary Report on Patentability, dated Jan. 5, 2012, The International Bureau of WIPO, Switzerland.

SYSTEM AND METHOD FOR ADJUSTING ROLLER CONE PROFILE ON HYBRID BIT

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The present inventions relate in general to earth-boring drill bits and, in particular, to a bit having a combination of rolling and fixed cutters and cutting elements and a method of drilling with same.

2. Description of the Related Art

U.S. Pat. No. 3,294,186 discloses the use of nickel shims for brazing of rock bit components.

U.S. Pat. No. 3,907,191 discloses a "rotary rock bit is constructed from a multiplicity of individual segments. Each individual segment includes two parting faces and a gage cutting surface. The individual segments are positioned adjacent each other with the parting faces of the adjacent segments in abutting relationship to one another. A ring gage is positioned around the segments and the individual segments are moved relative to one another causing the parting faces of an individual segment to slide against the parting faces of the adjacent segments. The segments are moved until the gage cutting surfaces of the segments contact the ring gage thereby insuring that the finished bit will have the desired gage size. The segments are welded together over a substantial portion of the parting faces."

U.S. Pat. No. 5,439,067 discloses a "rotary cone drill bit for forming a borehole having a one-piece bit body with a lower portion having a convex exterior surface and an upper portion adapted for connection to a drill string. A number of support arms are preferably attached to the bit body and depend therefrom. Each support arm has an inside surface with a spindle connected thereto and an outer surface. Each spindle projects generally downwardly and inwardly with respect to the associated support arm. A number of cone cutter assemblies equal to the number of support arms are mounted on each of the spindles. The support arms are spaced on the exterior of the bit body to provide enhanced fluid flow between the lower portion of the bit body and the support arms. Also, the length of the support arms is selected to provide enhanced fluid flow between the associated cutter cone assembly and the lower portion of the bit body. The same bit body may be used with various rotary cone drill bits having different gauge diameters."

U.S. Pat. No. 5,439,068 discloses a "rotary cone drill bit for forming a borehole having a one-piece bit body with a lower portion having a convex exterior surface and an upper portion adapted for connection to a drill string. The drill bit will generally rotate around a central axis of the bit body. A number of support arms are preferably attached to pockets formed in the bit body and depend therefrom. Each support arm has an inside surface with a spindle connected thereto and an outer surface. Each spindle projects generally downwardly and inwardly with respect to the longitudinal axis of the associated support arm and the central axis of the bit body. A number of cone cutter assemblies equal to the number of support arms are mounted respectively on each of the spindles. The spacing between each of the support arms along with their respective length and width dimensions are selected to enhance fluid flow between the cutter cone assemblies mounted on the respective support arms and the lower portion of the bit body. A lubricant reservoir is preferably provided in each support arm to supply lubricant to one or more bearing assemblies disposed between each cutter cone assembly and its associated spindle. Either matching openings and posts or matching keyways and keys may be used to position and align a portion of each support arm within its associated pocket during fabrication of the resulting drill bit.

U.S. Pat. No. 5,595,255 discloses a "rotary cone drill bit for forming a borehole having a bit body with an upper end portion adapted for connection to a drill string. The drill bit rotates around a central axis of the body. A number of support arms are preferably extend from the bit body. The support arms may either be formed as an integral part of the bit body or attached to the exterior of the bit body in pockets sized to receive the associated support arm. Each support arm has a lower portion with an inside surface and a spindle connected thereto and an outer shirttail surface. Each spindle projects generally downwardly and inwardly with respect to its associated support arm. A number of cutter cone assemblies equal to the number of support arms are mounted respectively on the spindles. A throat relief area is provided on the lower portion of each support arm adjacent to the associated spindle to increase fluid flow between the support arm and the respective cutter cone assembly."

U.S. Pat. No. 5,606,895 discloses a "rotary cone drill bit having a one-piece bit body with a lower portion having a convex exterior surface and an upper portion adapted for connection to a drill string. The drill bit will generally rotate around a central axis of the bit body to form a borehole. A number of support arms are preferably attached to pockets formed in the bit body and depend therefrom. The bit body and support arms cooperate with each other to reduce initial manufacturing costs and to allow rebuilding of a worn drill bit. Each support arm has an inside surface with a spindle connected thereto and an outer shirttail surface. Each spindle projects generally downwardly and inwardly with respect to the longitudinal axis of the associated support arm and the central axis of the bit body. A number of cone cutter assemblies equal to the number of support arms are mounted respectively on each of the spindles. The radial spacing of the support arms on the perimeter of the associated bit body along with their respective length and width dimensions are selected to enhance fluid flow between the cutter cone assemblies mounted on the respective support arms and the lower portion of the bit body. The resulting drill bit provides enhanced fluid flow, increased seal and bearing life, improved downhole performance and standardization of manufacturing and design procedures."

U.S. Pat. No. 5,624,002 discloses a "rotary cone drill bit having a one-piece bit body with a lower portion having a convex exterior surface and an upper portion adapted for connection to a drill string. The drill bit will generally rotate around a central axis of the bit body to form a borehole. A number of support arms are preferably attached to pockets formed in the bit body and depend therefrom. The bit body and support arms cooperate with each other to reduce initial manufacturing costs and to allow rebuilding of a worn drill bit. Each support arm has an inside surface with a spindle connected thereto and an outer shirttail surface. Each spindle projects generally downwardly and inwardly with respect to the longitudinal axis of the associated support arm and the central axis of the bit body. A number of cone cutter assemblies equal to the number of support arms are mounted respectively on each of the spindles. The radial spacing of the support arms on the perimeter of the associated bit body along with their respective length and width dimensions are selected to enhance fluid flow between the cutter cone assemblies mounted on the respective support arms and the lower portion of the bit body. The resulting drill bit provides enhanced fluid flow, increased seal and bearing life, improved downhole performance and standardization of manufacturing and design procedures."

U.S. Design Pat. No. D372,253 shows a support arm and rotary cone for modular drill bit.

The inventions disclosed and taught herein are directed to an improved hybrid bit having a combination of rolling and fixed cutters and cutting elements.

BRIEF SUMMARY OF THE INVENTION

The inventions disclosed and taught herein are directed to an earth boring drill bit designed for a specific performance, within a finished product tolerance, using components built to a looser manufacturing tolerance, and a method of assembling the bit. The bit may be assembled by selecting one or more legs from a plurality of pre-manufactured legs; selecting a bit body from a plurality of pre-manufactured bit bodies, the bit body having a slot for receiving the leg; placing the leg within the slot; and fixing the leg within the slot within the finished product tolerance by placing one or more shims between the leg and the slot. The leg and shims may be welded or bolted into the bit body. The number and/or thickness of the shims may be selected to bring the earth boring drill bit within the finished product tolerance. The shims may be used to adjust an axial position, a radial position, and/or circumferential position of the leg with respect to the slot, thereby adjusting the position of roller cone cutting elements associated with the leg with respect to fixed cutting elements secured to a blade of the bit body. The leg and the bit body may be selected, or produced, such that the leg will not fill the slot. For example, the bit body may be manufactured to ensure the bit will not meet the specification, given the manufacturing tolerance, without the shims. Additionally, or alternatively, the leg may be manufactured to ensure the leg will not meet the performance specification, given the manufacturing tolerance, without the shims.

DETAILED DESCRIPTION OF THE INVENTION

Figure 1:
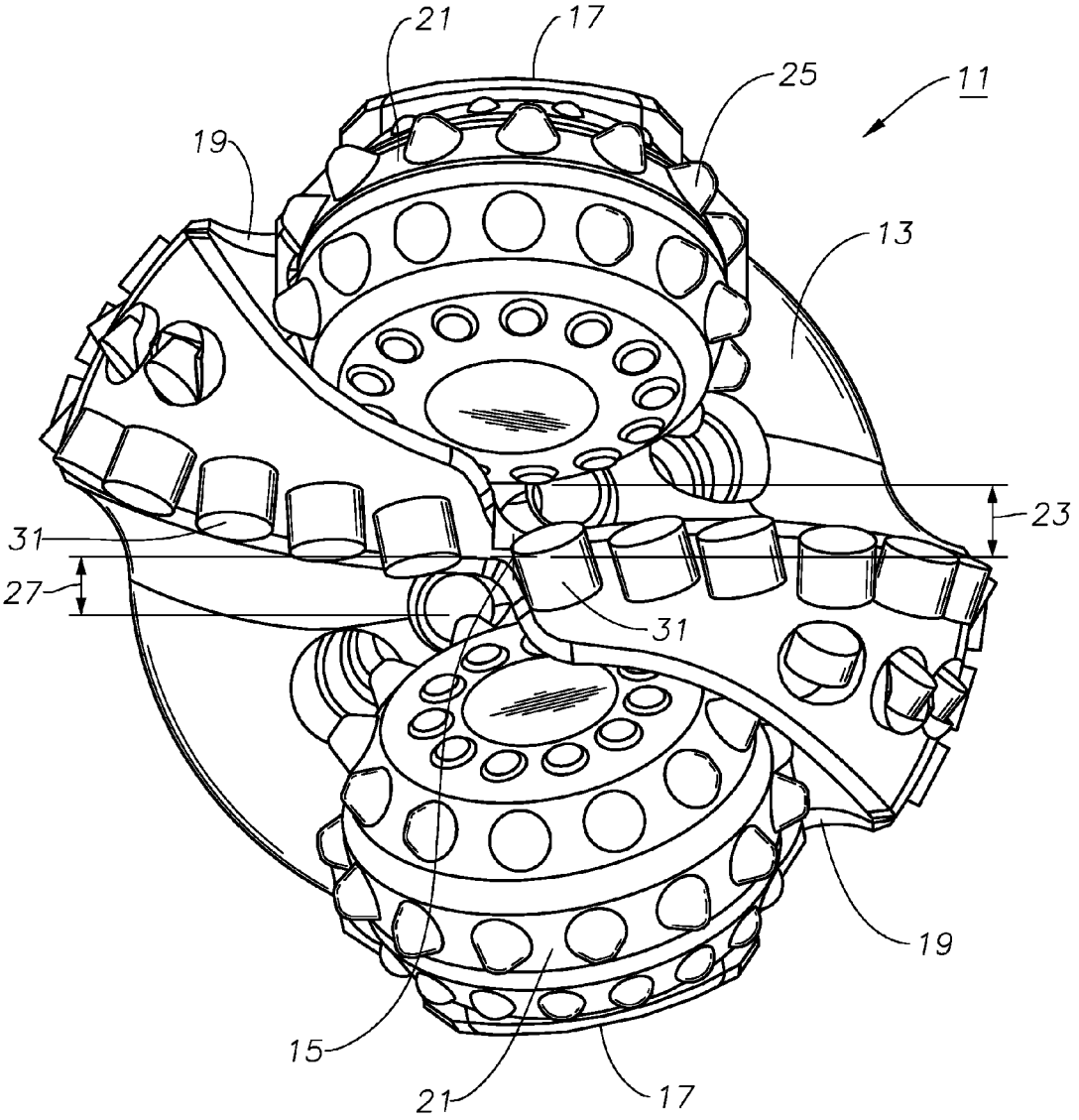
FIG. 1 is a bottom plan view of the embodiment of the hybrid earth-boring bit constructed in accordance with the present invention.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Applicants have created an earth boring drill bit designed for a specific performance, within a finished product tolerance, using components built to a looser manufacturing tolerance, and a method of assembling the bit. The bit may be assembled by selecting one or more legs from a plurality of pre-manufactured legs; selecting a bit body from a plurality of pre-manufactured bit bodies, the bit body having a slot for receiving the leg; placing the leg within the slot; and fixing the leg within the slot within the finished product tolerance by placing one or more shims between the leg and the slot. The leg and shims may be welded or bolted into the bit body. The number and/or thickness of the shims may be selected to bring the earth boring drill bit within the finished product tolerance. The shims may be used to adjust an axial position, a radial position, and/or circumferential position of the leg with respect to the slot, thereby adjusting the position of roller cone cutting elements associated with the leg with respect to fixed cutting elements secured to a blade of the bit body. The leg and the bit body may be selected, or produced, such that the leg will not fill the slot. For example, the bit body may be manufactured to ensure the bit will not meet the specification, given the manufacturing tolerance, without the shims. Additionally, or alternatively, the leg may be manufactured to ensure the leg will not meet the performance specification, given the manufacturing tolerance, without the shims.

Figure 2:
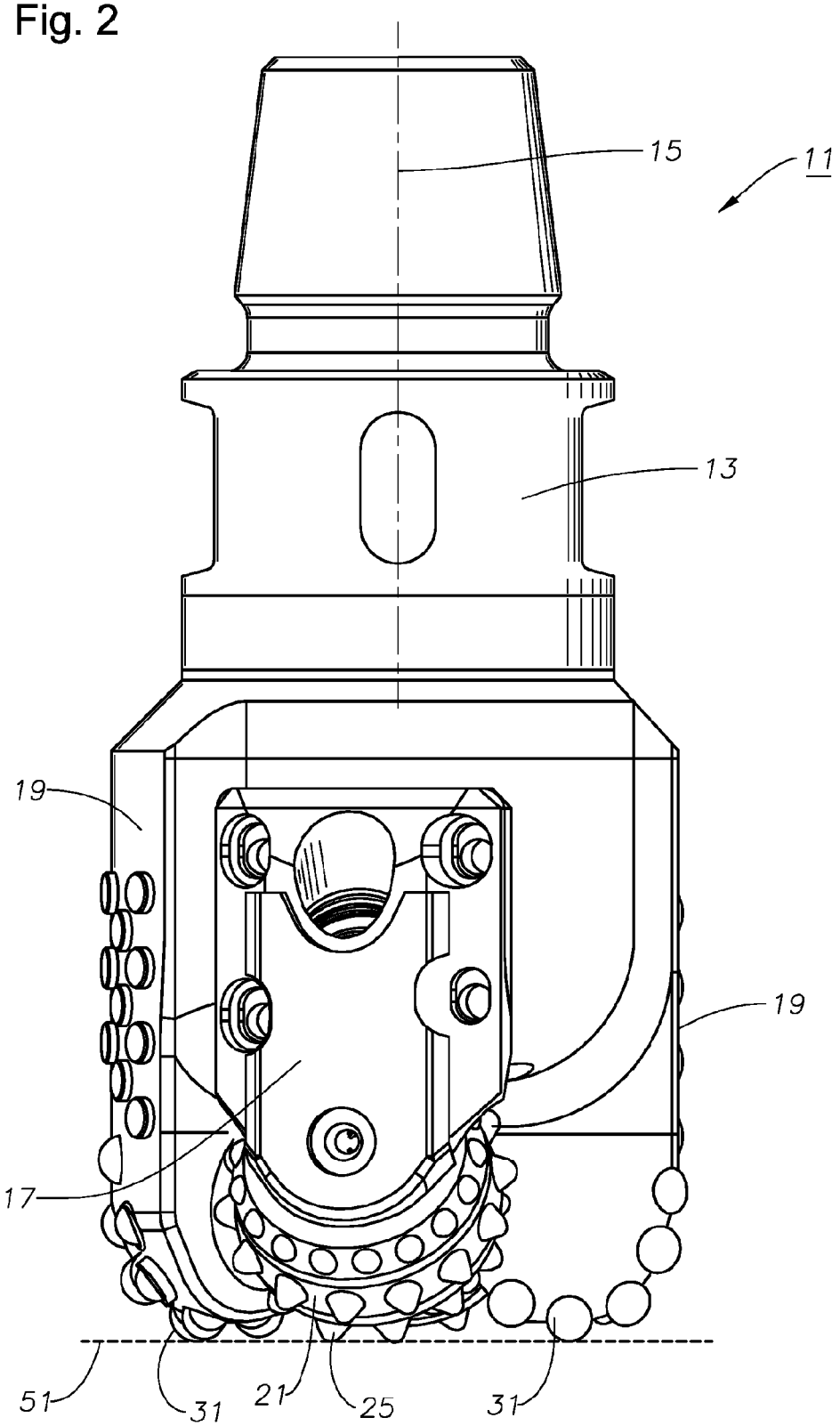
FIG. 2 is a side elevation view of an embodiment of the hybrid earth-boring bit of FIG. 1 constructed in accordance with the present invention.

Referring to FIGS. 1-2, an illustrative embodiment of a modular hybrid earth-boring drill bit is disclosed. The bit 11 the bit may be similar to that shown in U.S. Patent Application Publication No. 20090272582 and/or 20080296068, both of which are incorporated herein by specific reference. The bit 11 comprises a bit body 13 having a longitudinal axis 15 that defines an axial center of the bit body 13. A plurality (e.g., two shown) of bit legs or heads 17 extend from the bit body 13 in the axial direction, parallel to the longitudinal axis 15. Because the legs 17 are secured about the bit body 13, the legs may also protrude radially from the bit body 13. The bit body 13 also has a plurality of fixed blades 19 that extend in the axial direction.

Rolling cutters 21 are mounted to respective ones of the bit legs 17. Each of the rolling cutters 21 is shaped and located such that every surface of the rolling cutters 21 is radially spaced apart from the axial center 15 by a minimal radial distance 23. A plurality of rolling-cutter cutting inserts or elements 25 are mounted to the rolling cutters 21 and radially spaced apart from the axial center 15 by a minimal radial distance 27. The minimal radial distances 23, 27 may vary according to the application, and may vary from cutter to cutter, and/or cutting element to cutting element.

In addition, a plurality of fixed cutting elements 31 are mounted to the fixed blades 19. At least one of the fixed cutting elements 31 may be located at the axial center 15 of the bit body 13 and adapted to cut a formation at the axial center. In one embodiment, the at least one of the fixed cutting elements 31 is within approximately 0.040 inches of the axial center. Examples of rolling-cutter cutting elements 25 and fixed cutting elements 31 include tungsten carbide inserts, cutters made of super-hard material such as polycrystalline diamond, and others known to those skilled in the art.

Figure 3:
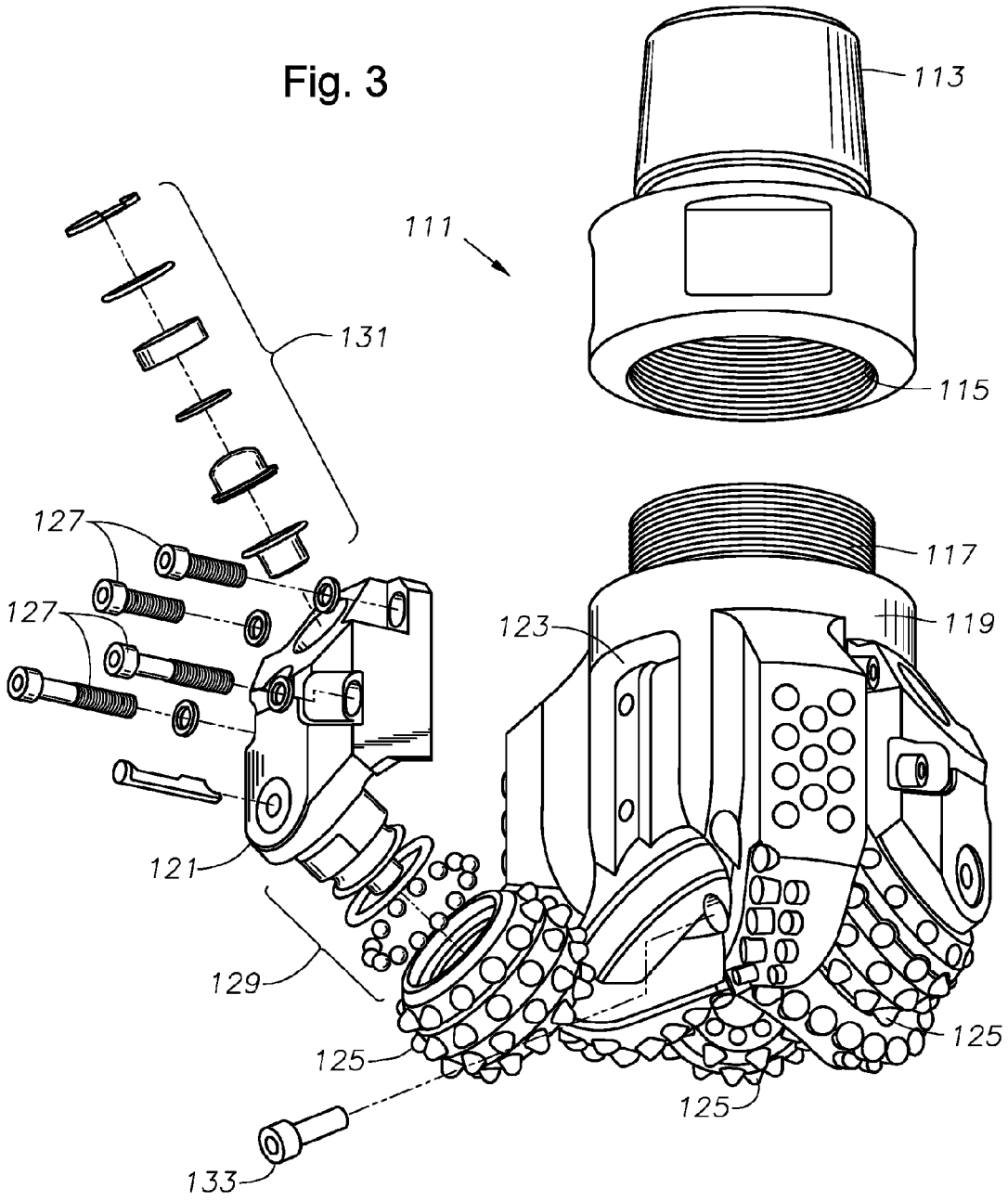
FIG. 3 is an exploded view of another embodiment of the hybrid earth-boring bit of FIG. 1 constructed in accordance with the present invention.
Figure 4:
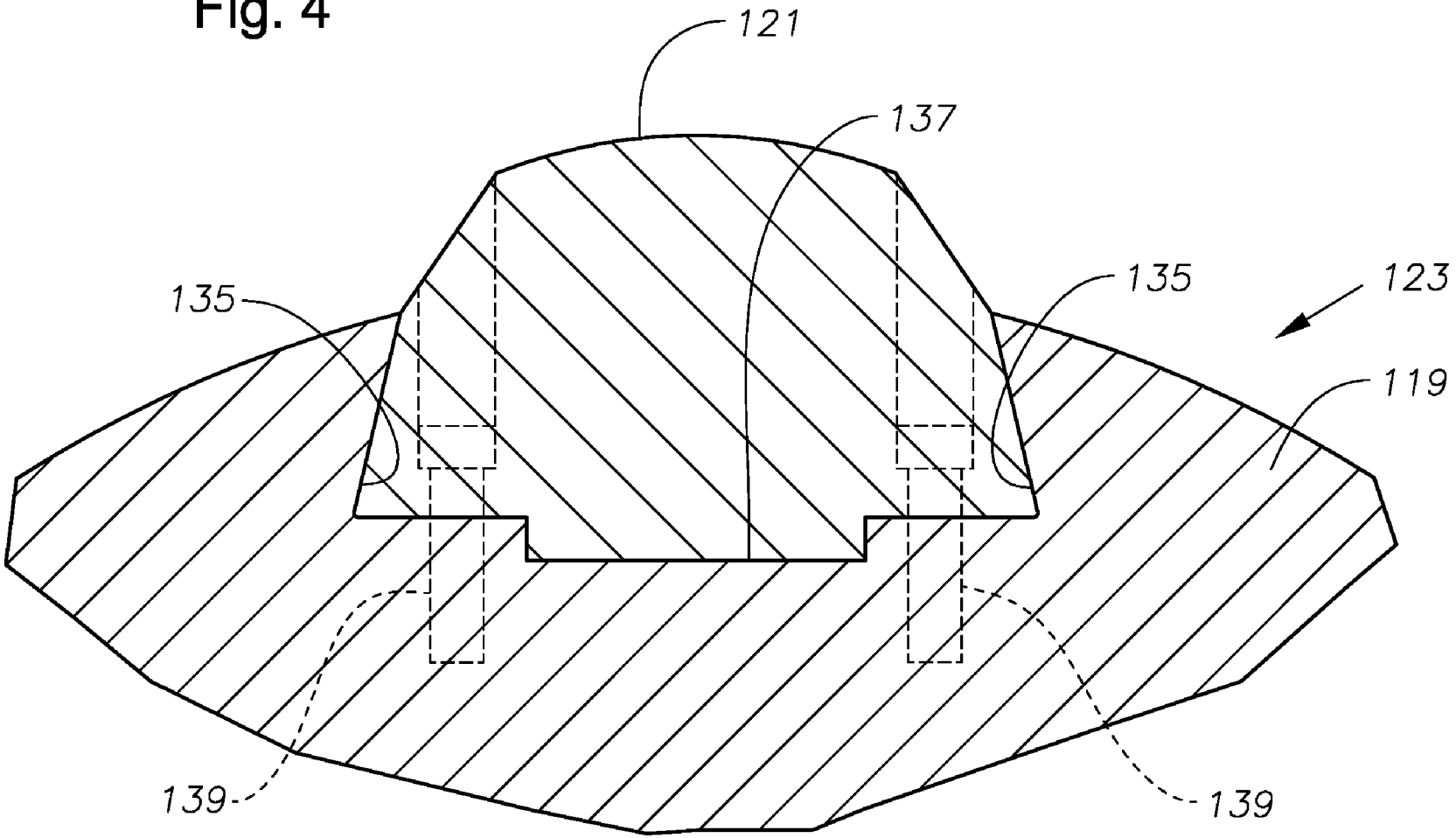
FIG. 4 is a cross-sectional view of a portion of the earth-boring bit of FIG. 3, illustrating the configuration of the axial slot in accordance with the present invention.

FIGS. 3 and 4 illustrate the modular aspect of the bit constructed according to the present invention. FIG. 3 is an exploded view of the various parts of the bit 111 disassembled. The illustrative embodiment of FIG. 3 is a three-cutter, three-blade bit. The modular construction principles of the present invention are equally applicable to the two-cutter, two-blade bit 11 of FIGS. 1 and 2, and hybrid bits with any combination of fixed blades and rolling cutters.

As illustrated, bit 111 comprises a shank portion or section 113, which is threaded or otherwise configured at its upper extent for connection into a drillstring. At the lower extent of shank portion 113, a generally cylindrical receptacle 115 is formed. Receptacle 115 receives a correspondingly shaped and dimensioned cylindrical portion 117 at the upper extent of a bit body portion 119. Shank 113 and body 119 portions are joined together by inserting the cylindrical portion 117 at the upper extent of body portion 119 into the cylindrical receptacle 115 in the lower extent of shank 113. For the 12¼ inch bit shown, the receptacle is a Class 2 female thread that engages with a mating male thread at the upper extent of the body. The circular seam or joint is then continuously bead welded to secure the two portions or sections together. Receptacle 115 and upper extent 117 need not be cylindrical, but could be other shapes that mate together, or could be a sliding or running fit relying on the weld for strength. Alternatively, the joint could be strengthened by a close interference fit between upper extent 119 and receptacle 115. Tack welding around, and/or fully welding, the seam could also be used.

A bit leg or head 121 (three are shown for the three-cutter embodiment of FIG. 3) is received in an axially extending slot 123 (again, there is a slot 123 for each leg or head 121). As shown in greater detail in FIG. 4, slot 123 is dovetailed (and leg 121 correspondingly shaped) so that only axial sliding of leg 121 is permitted and leg 121 resists radial removal from slot 123. A plurality (four) of bolts 127 and washers secure each leg 121 in slot 123 so that leg 121 is secured against axial motion in and removal from slot 123. A rolling cutter 125 is secured on a bearing associated with each leg 121 by a ball lock and seal assembly 129. The apertures in leg 121 through which bolts 127 extend may be oblong and/or oversized, to permit the axial and/or radial positioning of leg 121 within slot 123, which in turn permits selection of the relative projection of the cutting elements on each rolling cutter. A lubricant compensator assembly 131 is also carried in each leg 121 and supplies lubricant to the bearing assembly and compensates for pressure variations in the lubricant during drilling operations. At least one nozzle 133 is received and retained in the bit body portion 119 to direct a stream of drilling fluid from the interior of bit 111 to selected locations proximate the cutters and blades of the bit.

FIG. 4 is a fragmentary section view of bit body 119 illustrating the configuration of slot 123. As previously noted, slot 123 has a pair of adjacent opposing sides 135 that are inclined toward one another at an acute included angle (from vertical) to define a dovetail. A third side, which may be curved or flat, connects the two opposing sides 135. A rectilinear recess 137 is formed within the third side for additional engagement between the bit leg and bit body. As stated, bit leg 121 is provided with a corresponding shape so that once assembled together, bit leg 121 resists removal from slot 123 except by axial force. Preferably, for the 12¼ inch bit illustrated, slot 123 is approximately 3.880 inches wide at its widest point, opposing sides 135 are inclined at an angle of approximately 15 degrees and converge to define an included angle of approximately 30 degrees. Recess 137 is approximately 1.880 inches wide and approximately 0.385 inches deep. The corresponding surfaces of bit leg 121 are similarly dimensioned, but between 0.005 and 0.010 inch smaller to provide a sliding or running fit within the slot. A close interference fit could also be used to enhance strength, at the cost of ease of assembly. A blind threaded hole or aperture 139 is formed in bit body 119 to receive each of the fasteners or bolts 127 (FIG. 3). Alternatively, the opposed sides 135 of slot 123 could be "straight," but such a construction will not be as strong as the "dovetailed" construction and may unduly strain bolts 127.

Figure 5:
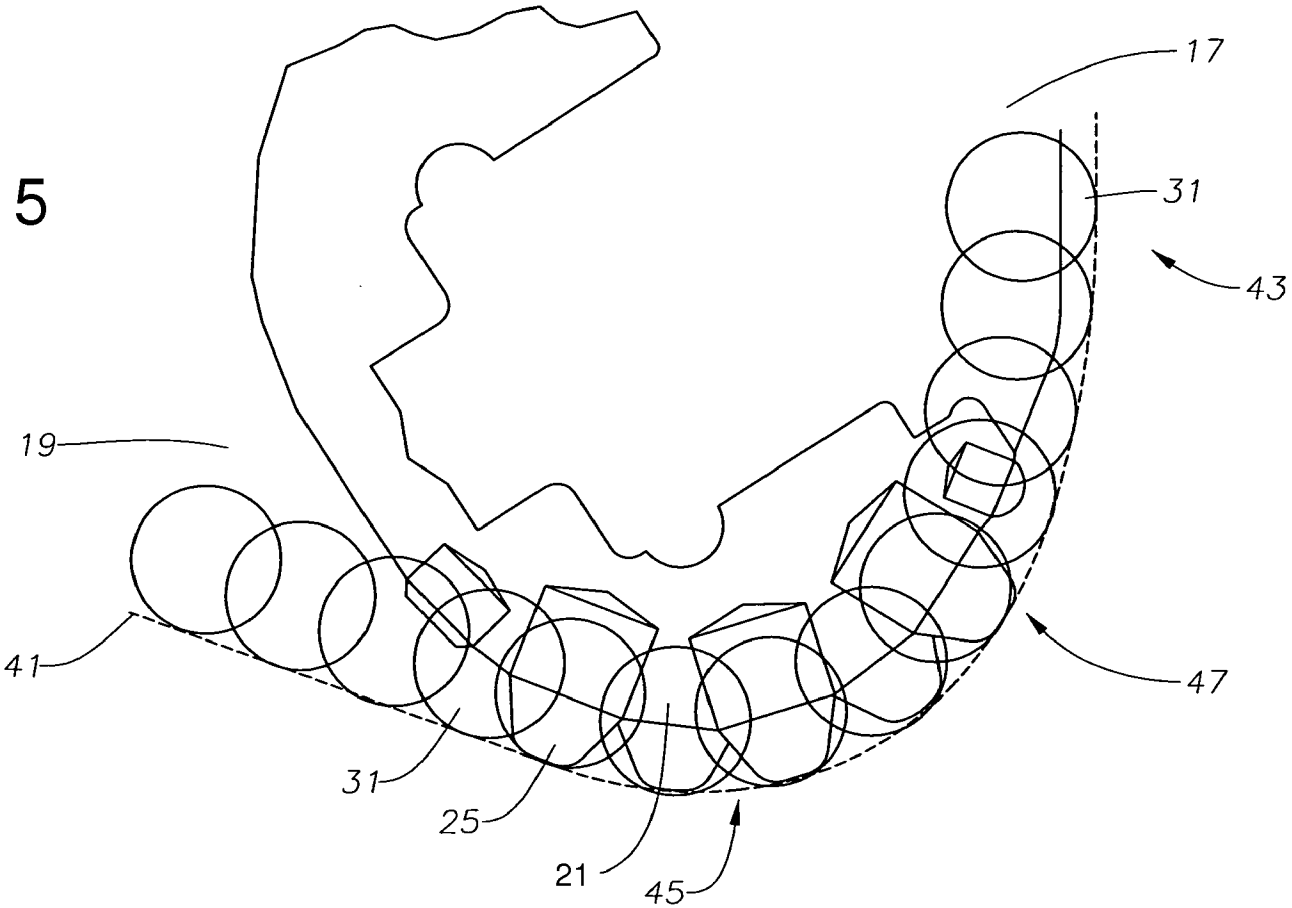
FIG. 5 is a composite rotational side view of the hybrid earth-boring drill bit of FIG. 1 constructed in accordance with the present invention.

As shown in FIG. 5, the roller cone cutting elements 25 and the fixed cutting elements 31 combine to define a cutting profile 41 that extends from the axial center 15 to a radially outermost perimeter 43 with respect to the axis. In one embodiment, only the fixed cutting elements 31 form the cutting profile 41 at the axial center 15 and the radially outermost perimeter 43. However, the roller cone cutting elements 25 overlap with the fixed cutting elements 31 on the cutting profile 41 between the axial center 15 and the radially outermost perimeter 43. The roller cone cutting elements 25 are configured to cut at the nose 45 and shoulder 47 of the cutting profile 41, where the nose 45 is the leading part of the profile (i.e., located between the axial center 15 and the shoulder 47) facing the borehole wall and located adjacent the radially outermost perimeter 43.

Thus, the roller cone cutting elements 25 and the fixed cutting elements 31 combine to define a common cutting face 51 (FIG. 2) in the nose 45 and shoulder 47, which are known to be the weakest parts of a fixed cutter bit profile. Cutting face 51 is located at a distal axial end of the hybrid drill bit 11. In one embodiment, at least one of each of the roller cone cutting elements 25 and the fixed cutting elements 31 extend in the axial direction at the cutting face 51 at a substantially equal dimension. In one embodiment, are radially offset from each other even though they axially align. However, the axial alignment between the distal most elements 25, 31 is not required such that elements 25, 31 may be axially spaced apart by a significant distance when in their distal most position. For example, the roller cone cutting elements 25 or the fixed cutting elements 31 may extend beyond, or may not fully extend to, the cutting face 51. In other words, the roller cone cutting elements 25 may extend to the cutting face 51 with the fixed cutting elements 31 axially offset from the cutting face 51.

Figure 6:
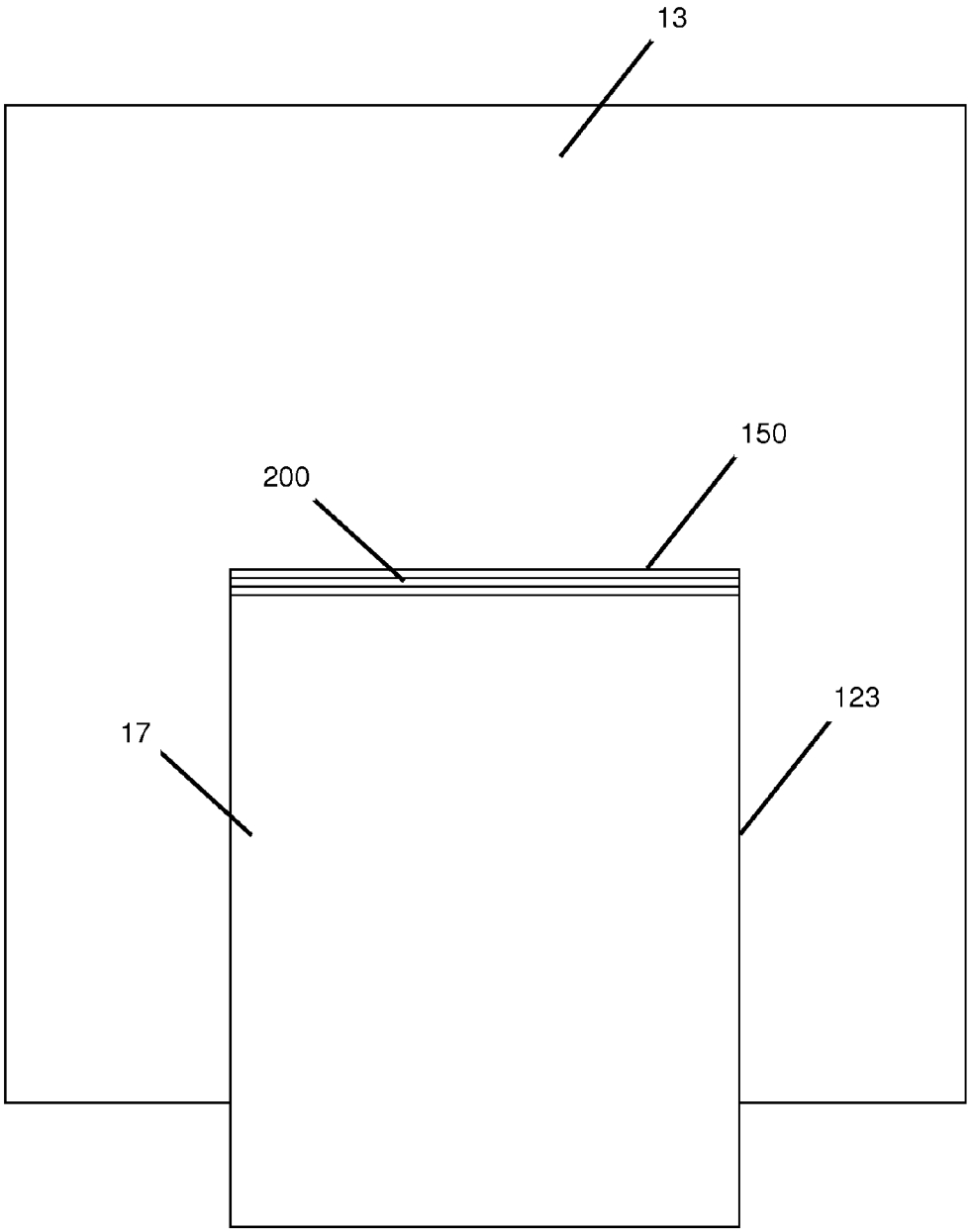
FIG. 6 is a simplified side view of the hybrid earth-boring drill bit of FIG. 1 constructed in accordance with the present invention.
Figure 7:
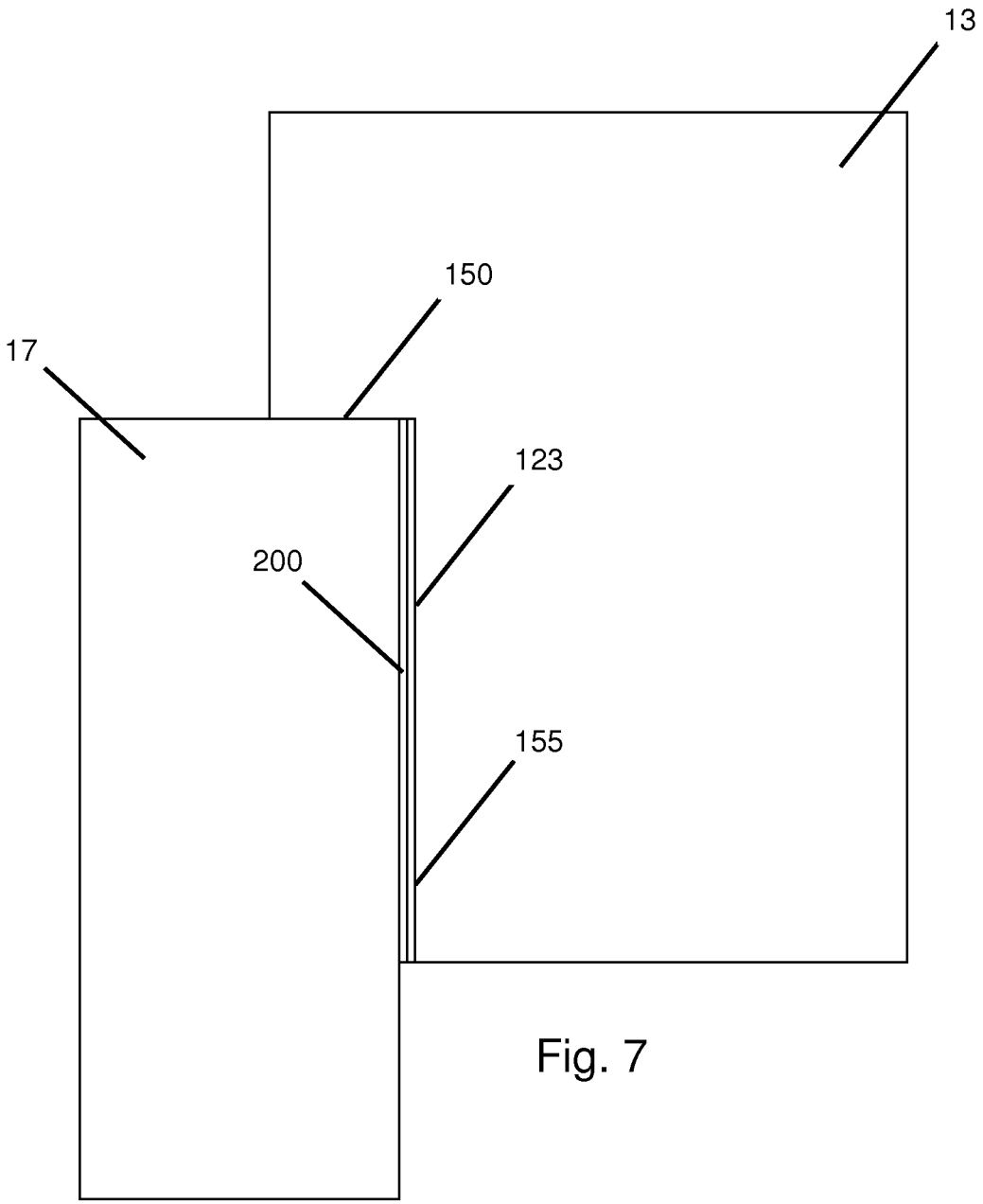
FIG. 7 is a simplified cross-sectional view of the hybrid earth-boring drill bit of FIG. 1 constructed in accordance with the present invention.
Figure 8:
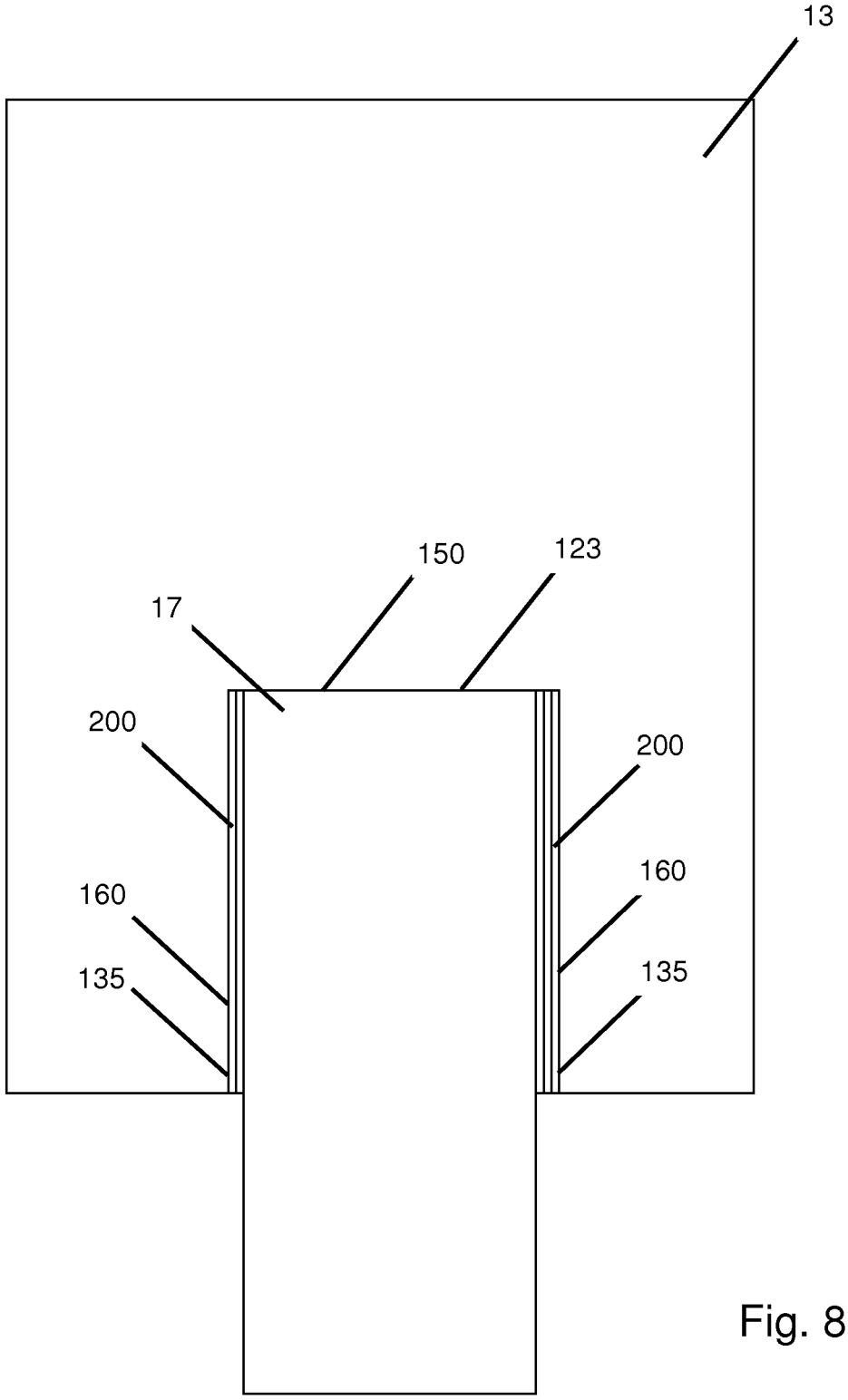
FIG. 8 is an alternative simplified side view of the hybrid earth-boring drill bit of FIG. 1 constructed in accordance with the present invention.

For example, assuming the fixed cutting elements 31 are fixed due to the integration of the blades 19 with the bit body 13, one may wish to manipulate the axial and/or radial position of the legs 17, thereby controlling the axial and/or radial position of the roller cone cutting elements 25 with respect to the fixed cutting elements 31 and/or the cutting profile 41. As shown in FIGS. 6, 7, and 8, the present invention provides this capability through the use of shims 200.

More specifically, one or more shims 200 may be placed in any or all of the slots 123 between the leg 17 and an axial wall 150 of the slot 123 in the bit body 13 to adjust the axial position of the roller cone cutting elements 25 with respect to the fixed cutting elements 31 and/or the cutting profile 41, as shown in FIG. 6. Additionally, or alternatively, one or more shims 200 may be placed in any or all of the slots 123 between the leg 17 and a radial wall 155 of the slot 123 in the bit body 13 to adjust the radial position of the roller cone cutting elements 25 with respect to the fixed cutting elements 31 and/or the cutting profile 41, as shown in FIG. 7. Additionally, or alternatively, one or more shims 200 may be placed in any or all of the slots 123 between the leg 17 and either circumferential wall 160, or opposed sides 135, of the slot 123 in the bit body 13 to adjust the circumferential position, or position around the circumference of the bit 11 relative to the slots 123, of the roller cone cutting elements 25 with respect to the fixed cutting elements 31 and/or the cutting profile 41, as shown in FIG. 8.

The shims 200 may have two parallel opposing surfaces, as shown, such that the leg 17 is positioned substantially parallel to the bit body 13, axis 15, and/or the walls 150,155 of the slot 123. Alternatively, the opposing surfaces may be convergent and/or divergent along the length of the shim 200, such that an angle between the leg 17 and the bit body 13, axis 15, and/or the walls 150,155 of the slot 123 may be manipulated. The shims 200 preferably extend the entire length of the walls 135,150,155,160 of the slot 123, but may be longer or shorter, as desired.

The shims 200 are preferably between 0.003 and 0.005 inches thick. However, the shims 200 may be between 0.003 and 0.015 inches thick. For example, the shims 200 may be between 0.005 and 0.015 inches thick. Alternatively, the shims 200 may be between 0.010 and 0.015 inches thick.

The shims 200 may also include apertures, such as those in leg 121 through which bolts 127 extend. The apertures may be oblong to allow adjustment of their position relative to the bolts 127. Alternatively, the apertures may be circular, thereby fixing their position relative to the bolts 127. In this case, the shims 200 may be fixed with respect to the bit body 13, but still allow the legs 17 to move relative thereto.

Furthermore, rather than the legs 16 being bolted to the body 13, the legs 17 may be welded, brazed, or otherwise fixedly secured to the bit body 13. In this case, the shims 200 may act as filler and included in the welding, brazing, or other process. In some embodiments, each shim 200 may be individually welded in place, one after another and/or on top of another, as needed, with the leg 17 thereafter being welded to the shims 200 and/or weld bead built up with the shims 200.

In any case, it can be seen how the shims 200 may be used to accommodate relatively loose manufacturing tolerances, and still allow the finished bit 11 to meet relatively tight finished product tolerances. This is done by selecting the number and/or thickness of shim(s) 200 necessary to meet a given finished product tolerance, with parts made to virtually any manufacturing tolerances. To further ensure this capability, the slots 123 may be oversized, i.e. larger, wider, and/or deeper than ultimately desired, and the legs 17 may be undersized, i.e. smaller, narrower, and/or shallower than ultimately desired, thereby allowing the excess space to be occupied, or made up, by more and/or thicker shims 200.

The shims 200 allow adjustment of the axial position, radial position, and/or circumferential position up to approximately one tenth of an inch, or even one eighth of an inch. For example, using current manufacturing capabilities, most bits appear to need between 0.020 and 0.030 inches of adjustment. However, other ranges of adjustment are contemplated, such as between 0.010 and 0.075 inches of adjustment, between 0.020 and 0.030 inches of adjustment, between 0.010 and 0.050 inches of adjustment, between 0.020 and 0.050 inches of adjustment, or between 0.015 and 0.030 inches of adjustment. Furthermore, one bit 11 may require difference ranges of adjustment of each position, such that the axial position is adjusted a different amount than the circumferential position, etc.

Figure 9:
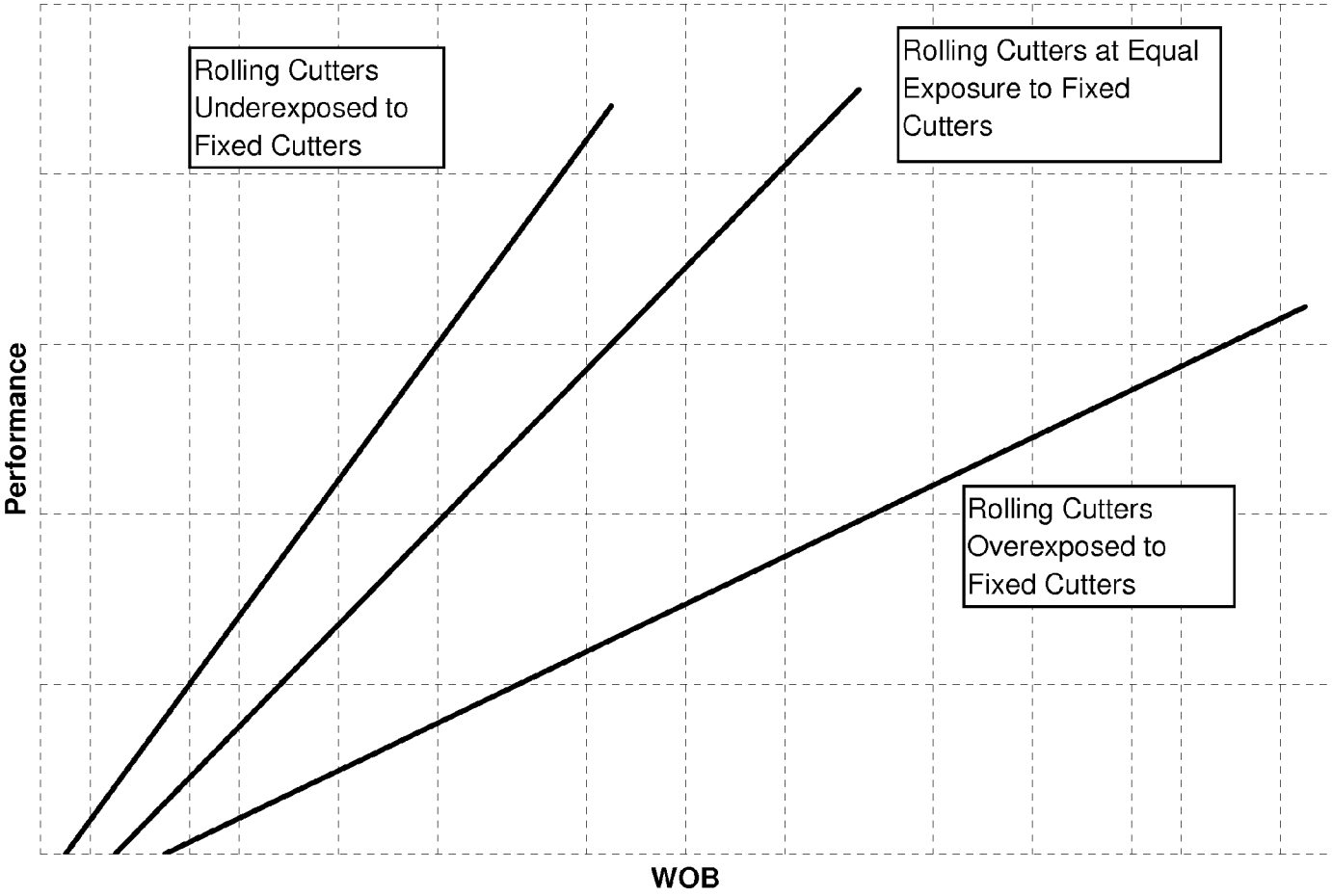
FIG. 9 is a graph showing bit performance for different relative positions of roller cone cutting elements with respect to fixed cutting elements.

In this manner, as shown in FIG. 9, the present invention allows the performance of the bit 11 to be fine tuned, given current manufacturing tolerances, which would not otherwise be able to produce such fine adjustment of the axial position, radial position, and/or circumferential position of the roller cone cutting elements 25 with respect to the fixed cutting elements 31 and/or the cutting profile 41. The performance may be specified in terms of rate of penetration (ROP), aggressiveness, durability, and/or another performance measure. For example, when the roller cone cutting elements 25 lead more, precede or are deeper than, or are overexposed with respect to, the fixed cutting elements 31, the resultant bit 11 is expected to be less aggressive, have a lower ROP, but be more durable. On the other hand when the fixed cutting elements 31 lead more, precede or are deeper than, or are overexposed with respect to, the roller cone cutting elements 25, or the roller cone cutting elements 25 lag, or are underexposed with respect to, the fixed cutting elements 31, the resultant bit 11 is expected to be more aggressive, have a higher ROP, but be less durable. These are relatively fine relationships, typically approximately within one tenth of an inch, or in some cases one eighth inch, either way, and are therefore beyond commonly attainable manufacturing tolerances. The shims 200 of the present invention provide this fine tuning of the performance characteristics of the bit 11.

The use of the shims 200 also allows preassembly of multiple bits without the need of expensive and complex jigs to hold the assembled bit while waiting to be welded. In this regard, the legs 17, with shims 200, may be assembled and then bolted together and/or tack welded before final welding occurs.

Other and further embodiments utilizing one or more aspects of the inventions described above can be devised without departing from the spirit of the invention. For example, the shims 200 may also be used along any of the walls of the slots 123, to accommodate independent adjustment of the axial position, radial position, or circumferential position, or any combination thereof. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A method of assembling an earth boring drill bit to meet a finished product tolerance relative to a desired aggressiveness of the finished drill bit using components built to a manufacturing tolerance, the method comprising the steps of:

selecting a bit body from a plurality of pre-manufactured bit bodies, the bit body having one or more axially extending slots;

selecting one or more legs from a plurality of pre-manufactured legs, the one or more legs including a region that is shaped to correspond with the shape of the one or more slots;

placing the one or more legs within the one or more slots; and fixing the one or more legs within the one or more slots to meet the desired aggressiveness within the finished product tolerance by placing one or more shims between the one or more legs and at least one of the walls of the one or more slots wherein the one or more shims adjust an axial location of the one or more leg in an axial direction parallel to a longitudinal axis of the bit body.

2. The method of claim 1, further including the step of welding the one or more legs and one or more shims into the bit body.

3. The method of claim 1, further including the step of bolting the one or more legs and the one or more shims into the bit body.

4. The method of claim 1, further including the step of selecting a number of the one or more shims to bring the earth boring drill bit within the finished product tolerance.

5. The method of claim 1, further including the step of selecting a thickness of the one or more shims to bring the earth boring drill bit within the finished product tolerance.

6. The method of claim 1, wherein the one or more shims adjust an axial position of roller cone cutting elements associated with the one or more legs with respect to fixed cutting elements secured to a blade of the bit body.

7. The method of claim 1, wherein the one or more shims adjust a circumferential position of the one or more legs with respect to the one or more slots.

8. The method of claim 1, wherein the one or more legs and the bit body are selected such that the one or more legs will not fill the one or more slots.

9. The method of claim 1, wherein the bit body is manufactured to ensure the one or more slots will not meet the desired aggressiveness, given the manufacturing tolerance.

10. The method of claim 1, wherein the one or more legs are manufactured to ensure the one or more legs will not meet the desired aggressiveness, given the manufacturing tolerance.

11. An earth boring drill bit designed to meet specified aggressiveness, within a finished product tolerance, using components built to a loose manufacturing tolerance, the bit comprising:

a bit body having a longitudinal axis defining an axial center of the bit body;

one or more bit legs;

rolling cutters mounted to each of the one or more bit legs, the rolling cutters having a plurality of cutting elements mounted thereon;

one or more blades that extend in an axial direction of the bit body, the one or more blades having a plurality of fixed cutting elements mounted thereon;

one or more slots in the bit body extending in a direction parallel to the longitudinal axis of the bit body for receiving each of the one or more bit legs; and one or more shims between the one or more bit legs and the one or more slots fixing the one or more legs within the one or more slots to meet the finished product tolerance, the one or more shims having a thickness that adjusts a position of the one or more bit legs with respect to the one or more slots in a direction parallel to the longitudinal axis of the bit body, thereby adjusting the axial position of roller cone cutting elements associated with the one or more legs with respect to fixed cutting elements secured to the one or more blades, and wherein the plurality of fixed legs are correspondingly shaped with respect to the one or more slots.

12. The bit of claim 11, wherein the one or more legs and the one or more shims are welded into the bit body.

13. The bit of claim 11, wherein the one or more legs and the one or more shims are attached to the bit body with one or more bolts extending through both the one or more legs and at least one of the one or more shims.

14. The bit of claim 11, wherein the one or more shims adjust the axial and/or the radial position of the one or more legs with regard to the earth boring drill bit.

15. The bit of claim 11, wherein the one or more shims have a thickness that adjusts a circumferential position of the one or more legs with respect to the one or more slots.

16. The bit of claim 11, wherein the one or more legs do not fill the one or more slots.

17. The bit of claim 11, wherein opposing side walls that define the one or more slots are inclined at an angle of about 15 degrees and converge to define an included angle of about 30 degrees.

18. The bit of claim 11, further comprising a rectilinear recess formed within the third wall.

* * * * *